US006948690B1

(12) United States Patent
Sandel

(10) Patent No.: US 6,948,690 B1
(45) Date of Patent: Sep. 27, 2005

(54) ARCHERY BOW STEADY REST AND HOLDER

(76) Inventor: Vernon Ralph Sandel, P.O. Box 467, Dollar Bay, MI (US) 49922-0467

( * ) Notice: Subject to any disclaimer, the term of this patent is extended or adjusted under 35 U.S.C. 154(b) by 180 days.

(21) Appl. No.: 10/448,377

(22) Filed: May 30, 2003

Related U.S. Application Data

(60) Provisional application No. 60/385,843, filed on Jun. 5, 2002.

(51) Int. Cl.[7] ..... A47B 96/00

(52) U.S. Cl. ..... 248/218.4; 42/94; 89/37.04; 124/86

(58) Field of Search ..... 248/218.4, 230.8, 248/230.1; 124/86, 88; 42/94; 89/37.04

(56) References Cited

U.S. PATENT DOCUMENTS 4,674,472 A 6/1987 Reis
5,320,085 A 6/1994 Hanneman
5,351,867 A 10/1994 Vest
5,482,241 A 1/1996 Oglesby
5,685,103 A * 11/1997 Wiggins ..... 42/94
5,806,508 A * 9/1998 Stempien et al. ..... 124/86
6,012,439 A * 1/2000 Woodruff ..... 124/1
6,059,240 A * 5/2000 Gorsuch ..... 248/219.4
6,694,661 B1 * 2/2004 Langford ..... 42/94
2003/0038218 A1 * 2/2003 Eppard et al. ..... 248/219.4

* cited by examiner

*Primary Examiner*—Ramon O Ramirez

(57) ABSTRACT

An Archery Bow Steady Rest and Holder for hunting which holds a bow in a ready vertical position in front of the archer with arrow nocked while waiting for game, and which also supports and steadies the bow and user's arm while drawing, aiming and firing. It comprises a swiveling support boom attached at its proximal end to a vertical surface, with vertical support elements attached near the distal end of the boom, and a bow attaching device holding the bow at the riser between the hand grip and upper limb. The bow may be freed from the support system simply by lifting it.

11 Claims, 3 Drawing Sheets

ARCHERY BOW STEADY REST AND HOLDER

This application claims benefit of Provisional Appl. 60/385,843 filed Jun. 5, 2002.

BACKGROUND OF THE INVENTION

Great strides have been made to make bow hunting available to the general public. With the advent of compound bows and modern sights even a rank beginner with a bow can participate in this increasingly popular sport. However, the compound bow and the attached equipment are heavier than the old bows, and holding the bow steady at arm's length while aiming and firing can be a problem, particularly for people with lesser physical strength. This problem is compounded in a hunting situation where the hunter may have to wait after drawing the bow for the game to move to a favorable spot or position before firing. This invention addresses the problem for hunting from a tree stand or a ground blind by providing a steady rest for the bow which steadies the bow while being aimed and fired. It does for the bow what a shooting rest does for rifle hunting. In addition, the bow rest holds the bow in a ready position with no effort from the user while waiting for game to appear.

DESCRIPTION OF THE PRIOR ART

In the prior art various types of devices have been proposed which have elements similar to the present invention. These fall into two broad categories: bow holders that hold the bow in a ready position while waiting for game to appear but require that the bow be removed before firing, and bow rests that steady the bow during firing and may also act as a bow holder.

A large number of bow holders have been described. U.S. Pat. No. 5,806,508 to Stempien et al is a pertinent example which discloses a bow holder having means to attach the holder to a vertical surface, a swivel device which holds a support and attachment device (knot) which holds the bow where the bow string joins the bow. The single support string of this device does not prevent the bow from rotating while suspended. The bow becomes disconnected from the support and attachment device when the bow is drawn, and thus provides no support for the bow's weight or the archer's arm while aiming and firing.

U.S. Pat. No. 6,059,240 to Gorsuch discloses a bow holder having means to attach the holder to a vertical surface, a swivel support which holds an L-shaped bracket which holds the bow where the bow string joins the bow. The bow must be removed from the support to draw and fire the bow.

U.S. Pat. No. 6,244,556 to Carillo et al discloses a bow holder which attaches to a seat bottom having a base plate, a platform with slot to support the bottom end of the bow, and a prop to hold the bow in a vertical position.

Examples of bow rests which steady the bow during the drawing, aiming and firing follow. U.S. Pat. No. 6,029,643 to Golfieri discloses a bow rest having a base which the archer stands on, a vertical support and a horizontal support attached to the vertical support. The horizontal support attaches to the bow at the threaded bore in the bow's riser ordinarily used for a stabilizer. Because of the size and lack of portability this device is not adaptable to hunting.

U.S. Pat. No. 5,509,400 to Chalin discloses a bow rest having a vertical, telescoping rod attached to a horizontal support which attaches to the riser of the bow through the threaded stabilizer port. The lower portion of the vertical telescoping rod supports the weight of the bow and archer's arm by resting on the user's foot. This device does not act as a bow holder.

A number of steady rests have been disclosed which do not attach to the bow, but steady the arm through bracing from some other part of the body or clothing. U.S. Pat. No. 5,351,867 to Vest is a representative example. It describes an arm steady rest which attaches to the belt or clothing of the user and provides an adjustable support to the forearm by means of two telescoping elements. This device does not act as a bow holder.

SUMMARY OF THE INVENTION

The present invention is directed to an archery bow rest which also acts as a bow holder, and is suitable for bow hunting from a ground blind or a tree stand. It consists of a swiveling support boom attached to a vertical surface and support elements that attach to the swiveling support boom at the top and to the bow at the bottom. This support structure holds the bow while waiting for game to appear and supports and steadies the bow and the user's arm when aiming and shooting. The bow is attached to the support structure at the riser in such a way that it does not interfere with the actions of the limbs or bowstring, and thus does not affect the trajectory of the arrow. The bow is also easily removed from the support structure if game is outside the range of movement of the Archery Bow Steady Rest and Holder.

It is an object of the present invention to provide a new and improved archery bow rest that greatly improves shooting accuracy by eliminating shaking of the bow.

It is an object of the present invention to provide a new and improved archery bow rest and holder that is practical for bow hunting.

It is an object of the present invention to provide a new and improved archery bow rest and holder that is light, portable, and easily set up.

It is an object of the present invention to provide a new and improved archery bow rest and holder that is inexpensive to make and easy to use.

It is an object of the present invention to provide a new and improved archery bow rest that holds the bow in a ready position without effort or attention from the user, and from which the bow does not have to be removed to draw and fire.

These and other objects and advantages of the present invention will be fully apparent from the following description, when taken in connection with the annexed drawings.

DESCRIPTION OF THE PREFERRED EMBODIMENT

Figure 1:
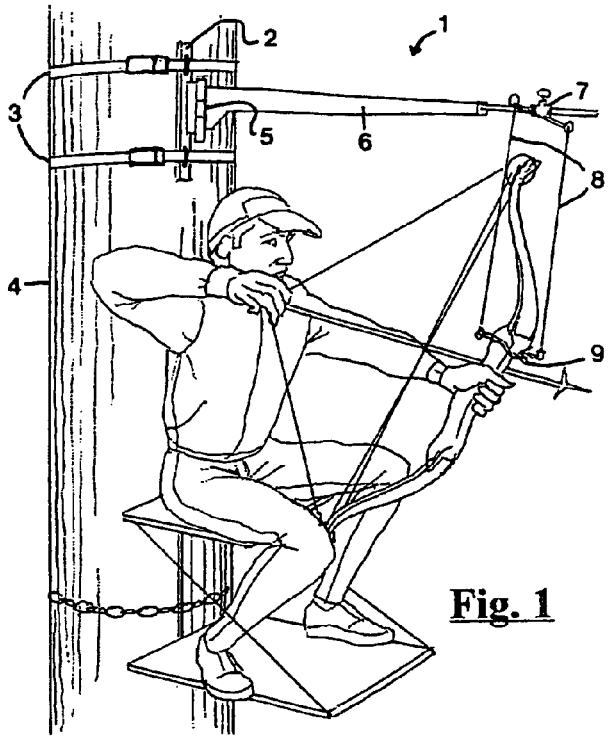
FIG. 1 is a view of the present invention being used as a steady rest while sitting in a tree stand.

The preferred embodiment of the present invention 1 being used as a steady rest is shown in FIG. 1. Its major parts are a vertical member 2, straps 3 that attach the vertical member to a vertical surface (usually a tree 4), a swivel 5 mounted boom 6 which allows horizontal movement and which bears the weight of bow and user's arm, a support element separator 7, two support elements 8, and a bow attaching device 9.

Figure 2:
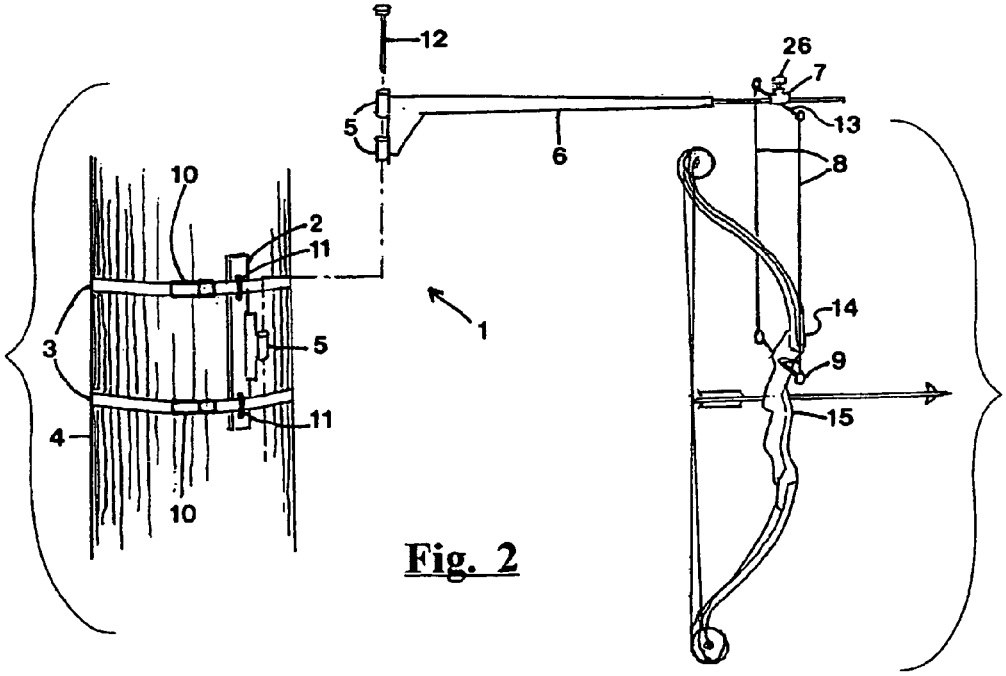
FIG. 2 is a view of the present invention holding a bow in a ready state (as a bow holder) while waiting for game. It also shows a detail of the preferred swivel device.

Referring now to the drawings in greater detail, FIG. 2 shows a schematic view of the present invention 1 holding a bow. The vertical member 2 of 1 is attached to a vertical surface such as a tree 4 by conventional straps 3 which encircle the tree 4 and are secured by any conventional fastener such as buckles or ratchet fasteners (ratchet straps) 10. While two straps are shown in FIG. 1, it should be understood that any means of attachment may be used as long as the bow rest is securely fastened to the vertical support 4.

For convenience in carrying and setup, the straps 3 are secured to a vertical member 2 by any conventional means such as loops 11. A boom 6 is attached to the vertical member 2 by means of a swivel 5 comprised of a plurality of tubes alternately attached the boom 6 and vertical member 2, again by any conventional means, and a pin 12 which threads through the tubes binding them together. The swivel 5 allows the boom to rotate about the vertical axis of the pin 12 and to be separated from the vertical member 2 for ease of installation of 1. Alternatively, the boom 6 can be permanently attached to a swivel 5 and vertical member 2.

In the preferred embodiment two vertical support elements 8 are attached to the boom 6 by means of a vertical support element separator 7. The lower ends of the vertical support elements are attached to the two end eyelets of a bow attaching device 9. The bow attaching device 9 holds a bow at the top of the riser 15 where it flares or projects out to form a pocket for the bow's upper limb 14.

Figure 3:
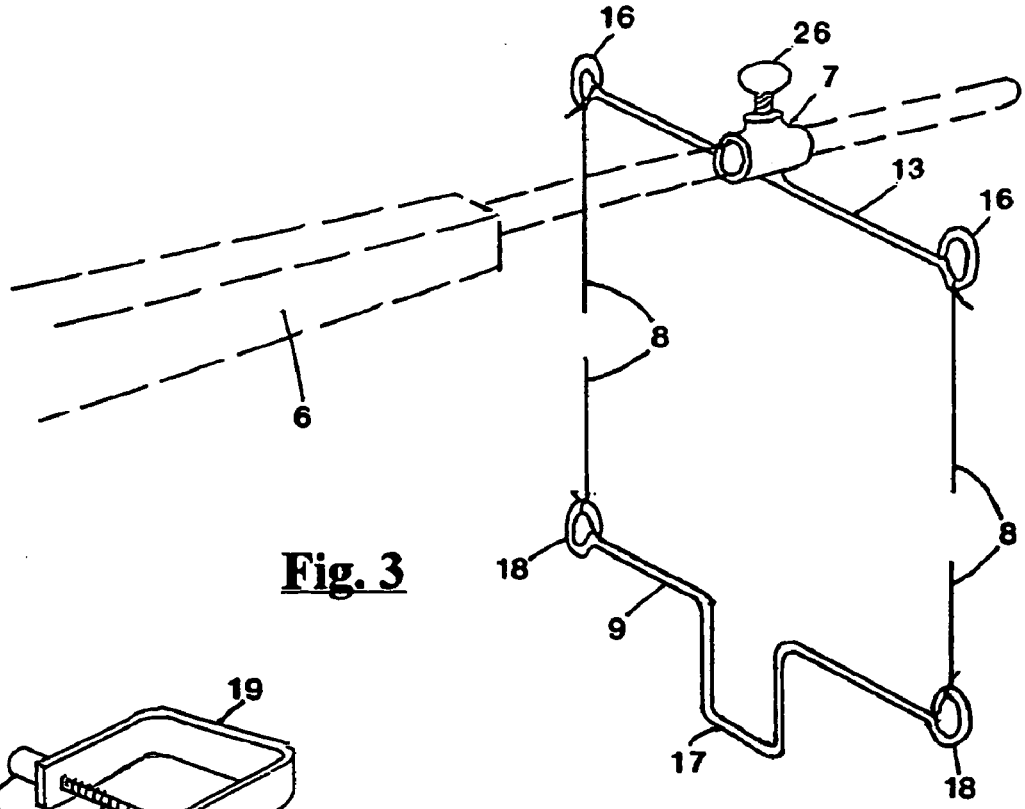
FIG. 3 is a detail view of the distal end of the support boom and its attachments in the preferred embodiment of present invention.

FIG. 3 shows an enlarged view of the distal end of the boom 6 and its attachments. In the preferred embodiment the vertical support element separator 7 is comprised of a tube with locking thumbscrew 26 and a rod 13 attached transversely to the tube. The vertical support element separator fits over the end of the boom 6, and the vertical support elements 8 are attached to eyelets 16 at the extremities of the rod 13 in any conventional manner. The purpose of the rod 13 is to separate the support elements 8 so that they do not touch or interfere with the bow's upper limb 14 (as shown in FIG. 2) when the bow is drawn and fired. This separation of the vertical support elements 8 also prevents the bow from rotating in the wind while held in the Archery Bow Steady Rest and Holder. It should be noted that the vertical support element separator 7 may be eliminated altogether by attaching the vertical support elements 8 directly to the boom 6 since the width of the bow attaching device 9 to which the lower extremities of the vertical support elements 8 are connected can provide sufficient separation. Without the vertical support element separator 7, however, the bow would have a greater tendency to rotate in wind. The vertical support element separator 7 can be permanently attached to the boom 6 or it can be detachably secured to the boom in any conventional manner. By making the attachment means adjustable on the boom 6, its position can be adjusted for the user's arm length.

The preferred vertical support elements 8 are strings, but any elements that will support the bow attaching device 9 can be used.

As shown in FIGS. 2 and 3 a bow attaching device 9 is connected to the vertical support elements 8. This bow attaching device engages the bow at the top of the riser 15 where it flares or projects to receive the upper limb 14 (the riser's upper limb pocket). The preferred shape of the bow attaching device is shown in detail in FIG. 3. At each end of the bow attaching device is an eyelet 18 to which the vertical support elements 8 attach by any conventional means. In the middle of the bow attaching device 9 is a notch 17 whose width is greater than the width of the narrower part of the riser but narrower than the flare or projection of the upper limb pocket at the top of the riser 15. When a bow is in the bow attaching device the notch supports the bow by engaging the two sides of the riser 15 where it flares or projects to form the upper limb pocket, but the bow can be released from the notch 17 simply by lifting the bow. The bow attaching device 9 can be covered with a sound deadening material such as, but not limited to, rubber to make removal of the bow silent.

The preferred vertical support elements (strings) 8 and form of the bow attaching device 9 shown in FIG. 3 are not meant to be exclusive. Any combination of a support system that does not interfere with the action of either the bow's limbs or bowstring, and a bow attachment system which holds a bow in an approximately vertical position at the riser between the hand grip and upper limb of a bow or a modified bow, which also allows the bow to be freed from the attachment system by lifting the bow will suffice. A person skilled in the trade could design many devices which meet these requirements. Examples of alternative methods of attaching a bow to the support system are shown in FIGS. 5, 6, 7 and 8.

Figure 4:
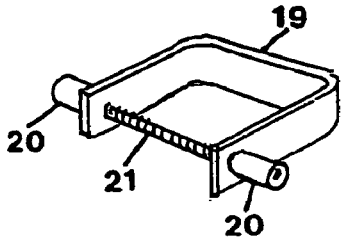
FIG. 4 shows a simple bracket that can be attached to a bow to provide horizontal pin projections to facilitate hanging certain bows in the present invention.
Figure 5:
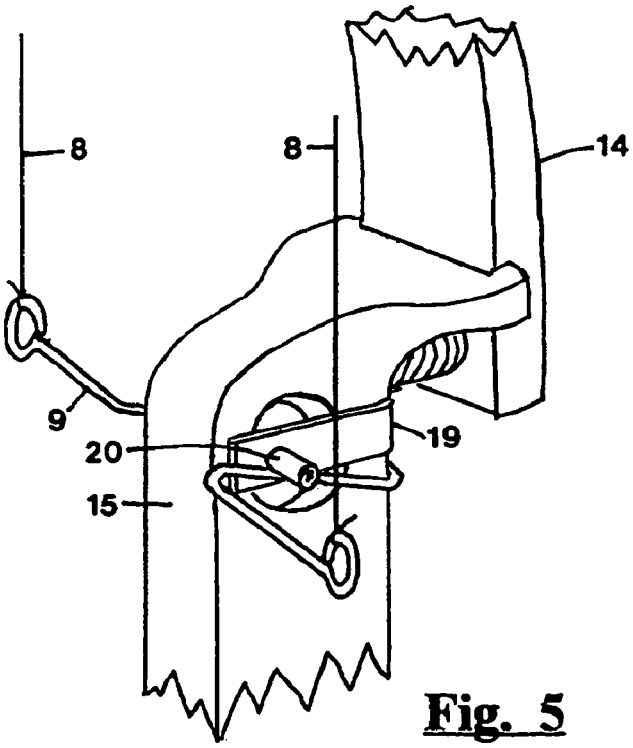
FIG. 5 is an example of an alternate method of attaching a bow to the present invention using the bracket of FIG. 4.

To facilitate hanging certain bows in the Archery Bow Steady Rest and Holder the simple bracket shown in FIG. 4 consisting of a U shaped bracket 19, a threaded rod 21 and two cylindrical nuts 20 may be installed on the bow as in FIG. 5 to provide pin projections 20 that engage the bow attaching device 9 to support the bow. Alternatively a small hole could be drilled through the riser 15 below the upper limb pocket to accept a threaded rod 21 and cylindrical nuts to provide pin projections 20 that engage the bow attachment device 9 to support the bow.

Figure 6:
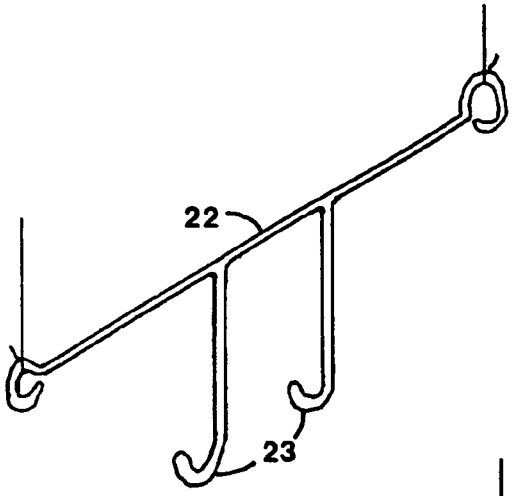
FIG. 6 shows an alternative bow attaching device for holding a pin modified bow.
Figure 7:
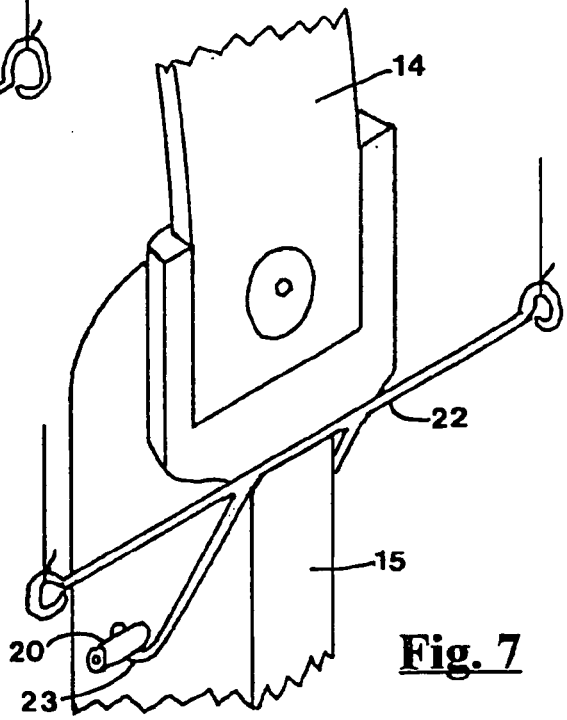
FIG. 7 shows how the alternative bow attaching device of FIG. 6 holds a pin modified bow.

FIG. 6 shows an example of an alternative bow attaching device suitable for use with a pin modified bow. The device 22 has two hooks 23 separated laterally by a distance slightly larger than the width of the riser 15 which engage the pin extensions 20 on both sides of the riser to support the bow as shown in FIG. 7. The weight of the bow keeps the hooks engaged, but lifting the bow will disengage it.

Figure 8:
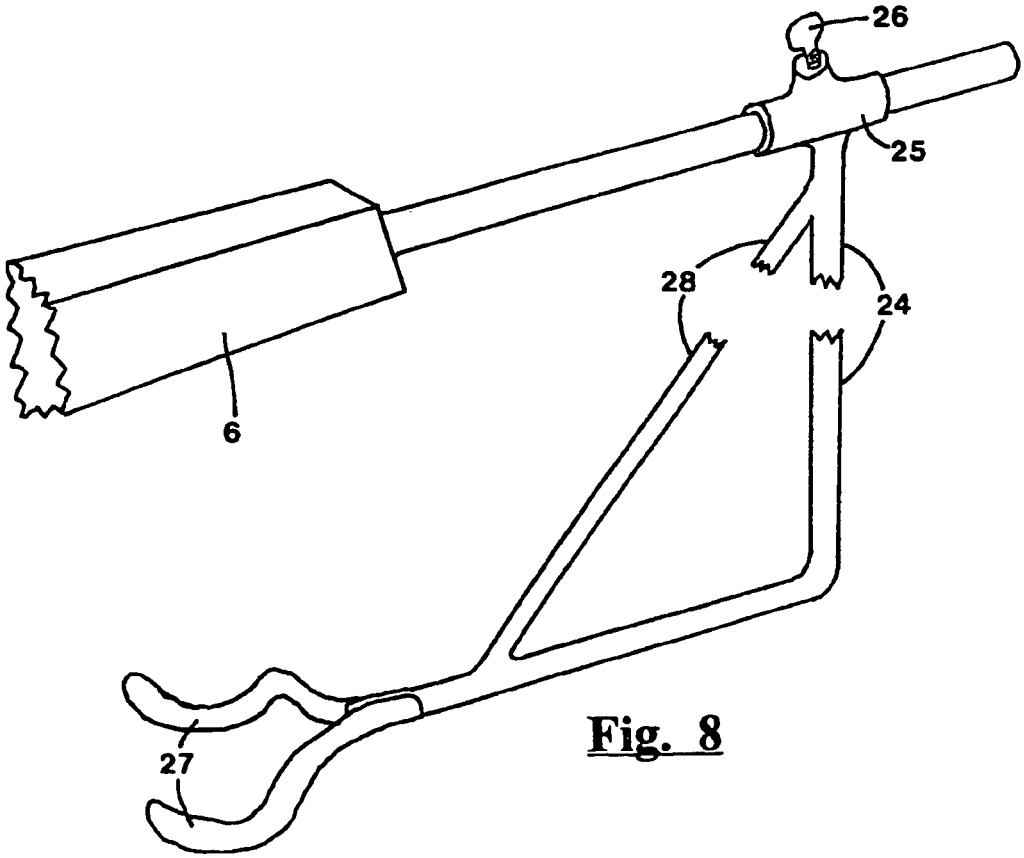
FIG. 8 shows an alternative rigid vertical system support and bow attaching device.

Another possible embodiment of the present invention is shown in FIG. 8. Vertical support of a bow attaching device is provided by a rigid "L" shaped rod 24 whose long end attached to sleeve 25. This sleeve slips over the support boom 6 and is secured with thumb screw 26. Two tines 27 separated laterally and extending from the short end of the "L" support the bow by engaging the flare or projection of the upper limb pocket as previously described, or by engaging pins 20 on a pin modified bow. For strength and to eliminate bounce a triangulating brace 28 is recommended.

SETUP AND USE OF THE ARCHERY BOW STEADY REST AND HOLDER

As shown in FIGS. 1 and 2, when a user wants to use the bow rest, he/she first attaches the vertical member 2 to a vertical surface 4 by means of straps 3 and ratchets 10. Next the riser of the bow 15 is slipped into the notch 17 (FIG. 3)

in bow attaching device 9. The bow should hang in the bow rest 1 high enough so that with the weight of the bow and the user's arm supported, the bow aims slightly above the elevation of any anticipated aiming point. After nocking an arrow the bow hangs in a ready position without any effort on the part of the hunter while waiting for game.

When game appears, the archer takes hold of the bow and string, draws the bow, and the bow rest 1 steadies the bow while aiming and firing. Since the weight of the bow and the user's arm is borne by the bow rest 1 sighting is more accurate. When the bow rest is properly installed a slight downward pressure is actually needed during sighting.

There is a somewhat limited ability to aim the bow in the vertical plane while in the Archery Bow Steady Rest and Holder, though some vertical flexibility results from stretching of the straps 3 (FIG. 1) that hold the steady rest to the vertical surface 4. Very little vertical flexibility is needed because the archer can move his body to provide vertical adjustment as one would when using a rifle with a shooting rest. If desired, greater vertical flexibility may be accomplished by: (1) making the boom 6 somewhat flexible, (2) using springy material for horizontal rod 13 of the vertical support element separator 7 (FIG. 3), or (3) using stretchable vertical support elements 8.

Although the Archery Bow Steady Rest and Holder and the method of using the same according to the present invention has been described in the forgoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim as my invention is:

1. An Archery Bow Steady Rest and Holder holding a bow in ready position and steadying the bow during aiming and firing comprising:

a bow having a riser, hand grip, upper limb, an upper limb pocket, and at least one projection between the hand grip and upper limb;

a vertical member which can be removably mounted to a vertical surface;

a swivel with vertical axis attached to the vertical member;

a substantially horizontal boom whose proximal end attaches to the swivel;

two vertical support elements attached near the distal end of the horizontal support boom, said elements being longer than the upper limb of the bow and separated laterally so that they do not interfere with the actions of the bow's upper limb;

a bow attaching device attaching to and separating the lower ends of the vertical support elements, said device having a form capable of holding the bow at the riser by engaging one or more projections in the riser between the hand grip and upper limb, said engagement being maintained by the weight of the bow.

2. The Archery Bow Steady Rest and Holder of claim 1 wherein the projections engaged by the bow attaching device are the two sides of the upper portion of the riser where it flares or projects out to form the upper limb pocket.

3. The Archery Bow Steady Rest and Holder of claim 1 wherein the bow has pin shaped projections on the sides of the riser between the hand grip and upper limb, and the bow attaching device engages the pin projections.

4. The Archery Bow Steady Rest and Holder of claim 3 wherein the bow attaching device is a rod with eyelets at each end attaching to and separating the lower ends of the vertical support elements horizontally, said rod having two hook shaped protrusions spaced slightly greater than the width of the riser below the upper limb pocket, which hooks engage two pin shaped projections of the bow with said projections.

5. The Archery Bow Steady Rest and Holder of claim 1 wherein the bow attaching device is a rod with eyelets at each end attaching to and separating the lower ends of the vertical support elements horizontally, said rod having an approximately "U" shaped notch at its center, the width of which is greater than the width of the bow riser below the upper limb pocket but less than the projections at the top of the riser.

6. The Archery Bow Steady Rest and Holder of claim 1 wherein the upper ends of the vertical support elements are attached to the extremities of a horizontal rod mounted transverse to and movably attached to the boom, separating and supporting the vertical support elements at their upper end.

7. An Archery Bow Steady Rest and Holder holding a bow in a ready position and steadying the bow during aiming and firing comprising:

a bow having a riser, hand grip, upper limb, an upper limb pocket, and at least one projection between the hand grip and upper limb;

a vertical member which can be removably mounted to a vertical surface;

a swivel with vertical axis attached to the vertical member;

a substantially horizontal boom whose proximal end attaches to the swivel;

a bow support system comprised of a rigid approximately "L" shaped vertical support, the longer vertical member being longer than the upper limb of the bow and attached at its upper end to the boom at or near the distal end, said attachment having a locking device or connection which prevents rotation or flexibility at the attachment, and the shorter approximately horizontal member extending in the direction from which a bow can be inserted, with a bow attaching device extending from the end of the horizontal member, said attaching device having a form capable of holding a bow at the riser by engaging one or more projections in the riser between the hand grip and upper limb, said engagement being maintained by the weight of the bow.

8. The Archery Bow Steady Rest and Holder of claim 7 wherein a triangulating brace is attached to the two members of the "L" shaped support to strengthen and maintain the angle between the two members.

9. The Archery Bow Steady Rest and Holder of claim 7 wherein the bow attaching device is a pair of tines spaced greater than the width of the riser below the upper limb pocket but less than the width of projections in the riser between the hand grip and upper limb.

10. The Archery Bow Steady Rest and Holder of claim 9 wherein the projections engaged by the tines are the two sides of the upper portion of the riser where it flares or projects to form the upper limb pocket.

11. The Archery Bow Steady Rest and Holder of claim 9 wherein the bow has pin shaped projections on opposing surfaces of the riser between the hand grip and the upper limb pocket and the tines engage the pin projections.

* * * * *